US005163389A

United States Patent [19]

Fujikawa et al.

[11] Patent Number: 5,163,389

[45] Date of Patent: Nov. 17, 1992

[54] HYDRAULIC VALVE LIFTER HAVING FUNCTION TO STOP VALVE DRIVE

[75] Inventors: Toru Fujikawa, Obu; Yasuhiro Kobayashi, Chiryu; Tadashi Terazawa, Toyota, all of Japan

[73] Assignee: Aisin Seiki Kabushiki Kaisha, Kariya, Japan

[21] Appl. No.: 858,497

[22] Filed: Mar. 27, 1992

[30] Foreign Application Priority Data

Mar. 28, 1991 [JP] Japan ..... 65-87196

[51] Int. Cl.[5] ..... F01L 1/34; F02D 13/06

[52] U.S. Cl. ..... 123/90.16; 126/198 F; 126/321

[58] Field of Search ..... 123/90.15, 90.16, 90.48, 123/198 F, 321

[56] References Cited

U.S. PATENT DOCUMENTS

| | | | |
|---|---|---|---|
| 3,786,792 | 1/1974 | Pelizzoni et al. | 123/90.16 |
| 4,337,739 | 7/1982 | Jordan | 123/90.16 |
| 4,469,061 | 9/1984 | Ajiki et al. | 123/90.16 |
| 4,475,497 | 10/1984 | Honda et al. | 123/90.16 |
| 4,509,467 | 4/1985 | Arai et al. | 123/90.16 |
| 4,522,169 | 6/1985 | Arai et al. | 123/90.16 |
| 4,546,734 | 10/1985 | Kodama | 123/90.16 |
| 4,770,137 | 9/1988 | Okabe et al. | 123/198 F |

FOREIGN PATENT DOCUMENTS

| | | | |
|---|---|---|---|
| 61-11411 | 1/1986 | Japan . | |
| 564507 | 10/1944 | United Kingdom | 123/90.16 |
| 2006373 | 5/1979 | United Kingdom | 123/90.16 |

*Primary Examiner*—E. Rollins Cross
*Assistant Examiner*—Weilun Lo
*Attorney, Agent, or Firm*—Oblon, Spivak, McClelland, Maier & Neustadt

[57] ABSTRACT

A hydraulic valve lifter having function to stop valve drive comprises a cylinder, a lifter body sliding in the cylinder, a cam driving the lifter body, a tappet sliding in the lifter body, a valve driven by the tappet, a plunger located between the lifter body and the tappet, a reservoir formed in the lifter body and being in fluid communication with a hydraulic source always, a first pressure room formed in the tappet and separated from the reservoir via the plunger, a check valve controlling a communication between the reservoir and the first pressure room, a piston sliding in the lifter body and having a rod driving the check valve, a second pressure room located at one side of the piston and being in fluid communication with the hydraulic source via a control valve, a room located at the other side of the piston, and a passage decreasing a pressure in the room.

2 Claims, 2 Drawing Sheets

HYDRAULIC VALVE LIFTER HAVING FUNCTION TO STOP VALVE DRIVE

BACKGROUND OF THE INVENTION

1. Field of the Invention

The present invention elates to a hydraulic valve lifter having function to stop valve drive and more particularly to a hydraulic valve lifter having function to stop valve drive for an engine.

2. Description of the Related Art

A conventional hydraulic valve lifter having function to stop valve drive 73 for an engine shown in FIG. 2, is disclosed in Japanese Patent Laid-open No. 61(1986)-11411. Here, a hydraulic valve lifter 71 is located in a cylinder 72 formed in an engine block 73. A lifter body 74 contacts with an outer surface of a cam 75 and a tappet 76 contacts with one end of a valve stem 77. A ring 84 prevents the tappet 76 from falling out from the lifter body 74. A valve spring 78 is interposed between a retainer 79 fixed to the valve stem 77 and a retainer 80 located on a bottom of the cylinder 72.

A room formed between the lifter body 74 and the tappet 76 is divided into a reservoir 81 and a pressure room 82 by a plunger 83. The reservoir 81 is in fluid communication with a hydraulic source 85 via a hydraulic line 86 and through holes 87,88. The pressure room 82 is in fluid communication with the reservoir 81 via an orifice 89. The orifice 89 is opened and closed by a check valve 90. A spring 91 is interposed between the tappet 76 and the plunger 83 and urges the tappet 76 downwardly.

A piston 92 having a rod 93 si located in a cylinder 94 and is urged upwardly by a spring 95. A pressure room 96 formed in the lifter body 74 is in fluid communication with the hydraulic source 85 via a hydraulic line 97, valve 98 controlled by controller 100 and through hole 99.

In the above mentioned hydraulic valve lifter 71, when the valve 98 is closed, a pressure in the pressure room 96 is low. So the rod 93 parts from the check valve 98, and the pressure room 82 has been kept in high pressure condition by being supplied with the hydraulic pressure from the hydraulic source 85. Thus, a rotating torque of the cam 75 is transmitted to a valve 101 via the lifter body 74, plunger 83, the pressure room 82 having a rigidity by the hydraulic pressure therein and tappet 76.

On the other hand, if a vertical motion of the valve 101 is not needed, the controller 100 controls the valve 98 in the opening condition. So, the pressure room 96 becomes in high pressure condition, and the rod 93 presses the check valve 90 via the piston 92. Thus, the pressure room 82 is in fluid communication with the reservoir 81 via the orifice 89, and the rigidity of the pressure room 82 disappears. As a result, the rotating torque of the cam 75 is not transmitted to the valve 101.

Here, the hydraulic pressure in the reservoir 81 urges the piston upwardly. So, when the hydraulic pressure is supplied to the pressure room 96, moving responses of the piston 92 and rod 93 is bad. Thus, the vertical motion of the valve 101 dose not stop immediately, when it is not needed.

SUMMARY OF THE INVENTION

Accordingly, it is a primary object of the present invention to improve a response of hydraulic valve lifter having function to stop valve drive.

The above and other objects are achieved according to the present invention by a hydraulic valve lifter having function to stop valve drive which comprises a cylinder, a lifter body sliding in the cylinder, a cam driving the lifter body, a tappet sliding in the lifter body, a valve driven by the tappet, a lunger located between the lifter body and the tappet, a reservoir formed in the lifter body and being in fluid communication with a hydraulic source always, a first pressure room formed in the tappet and separated from the reservoir via the plunger, a check valve controlling communication between the reservoir and the first pressure room, a piston sliding in the lifter body and having a rod driving the check valve, a second pressure room located at one side of the piston and being in fluid communication with the hydraulic source via a control valve, a room located at the other side of the piston, and a passage decreasing a pressure i the room.

BRIEF DESCRIPTION OF THE DRAWINGS

A more complete appreciation of the invention and many of the attendant advantages thereof will e readily obtained as the same becomes better understood by reference to the following detailed description when considered in connection with the accompanying drawing, wherein.

DETAILED DESCRIPTION OF THE INVENTION

Figure 1:
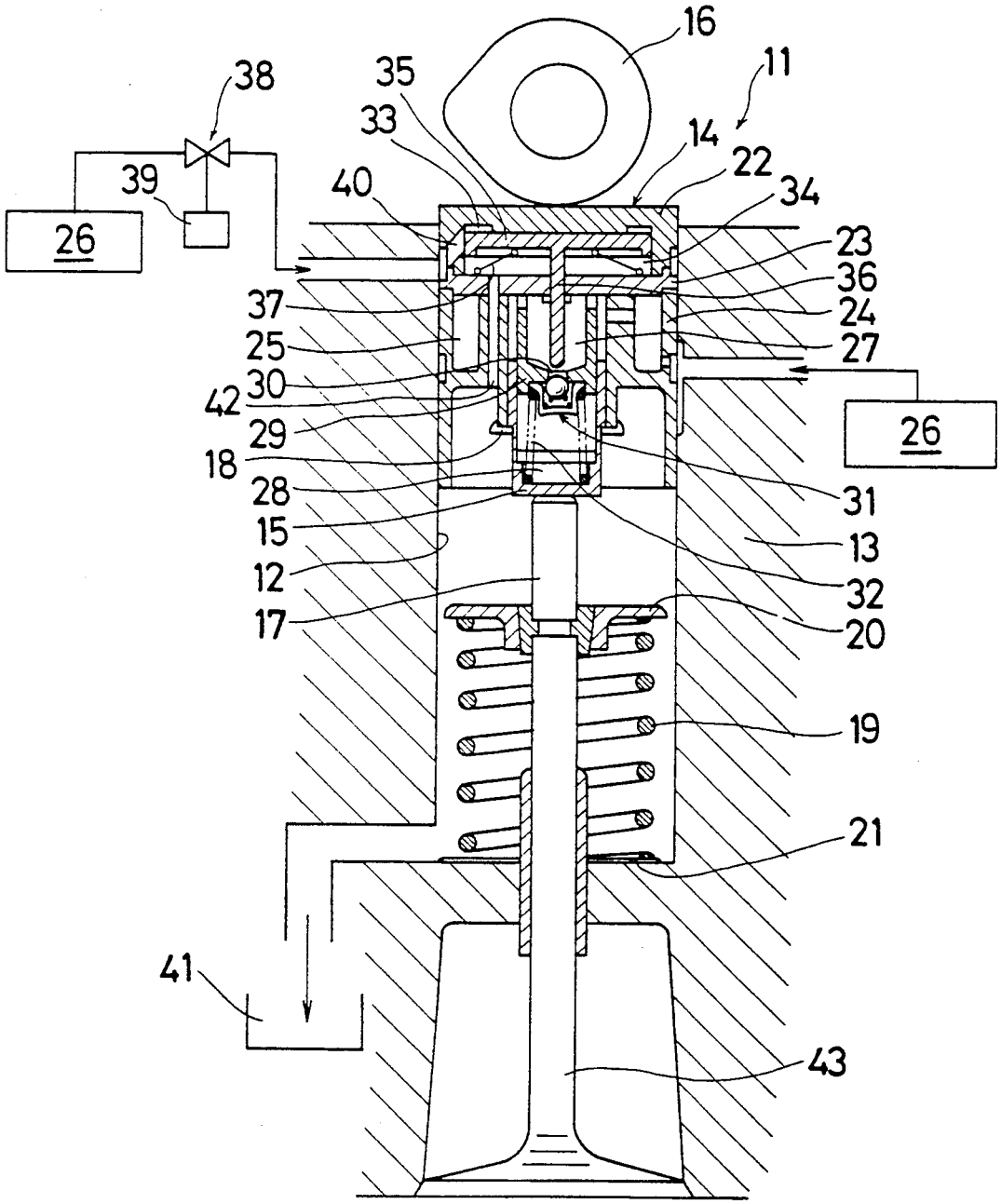
FIG. 1 is an elevational view of a hydraulic valve lifter having function to stop valve drive according to the invention.
Figure 2:
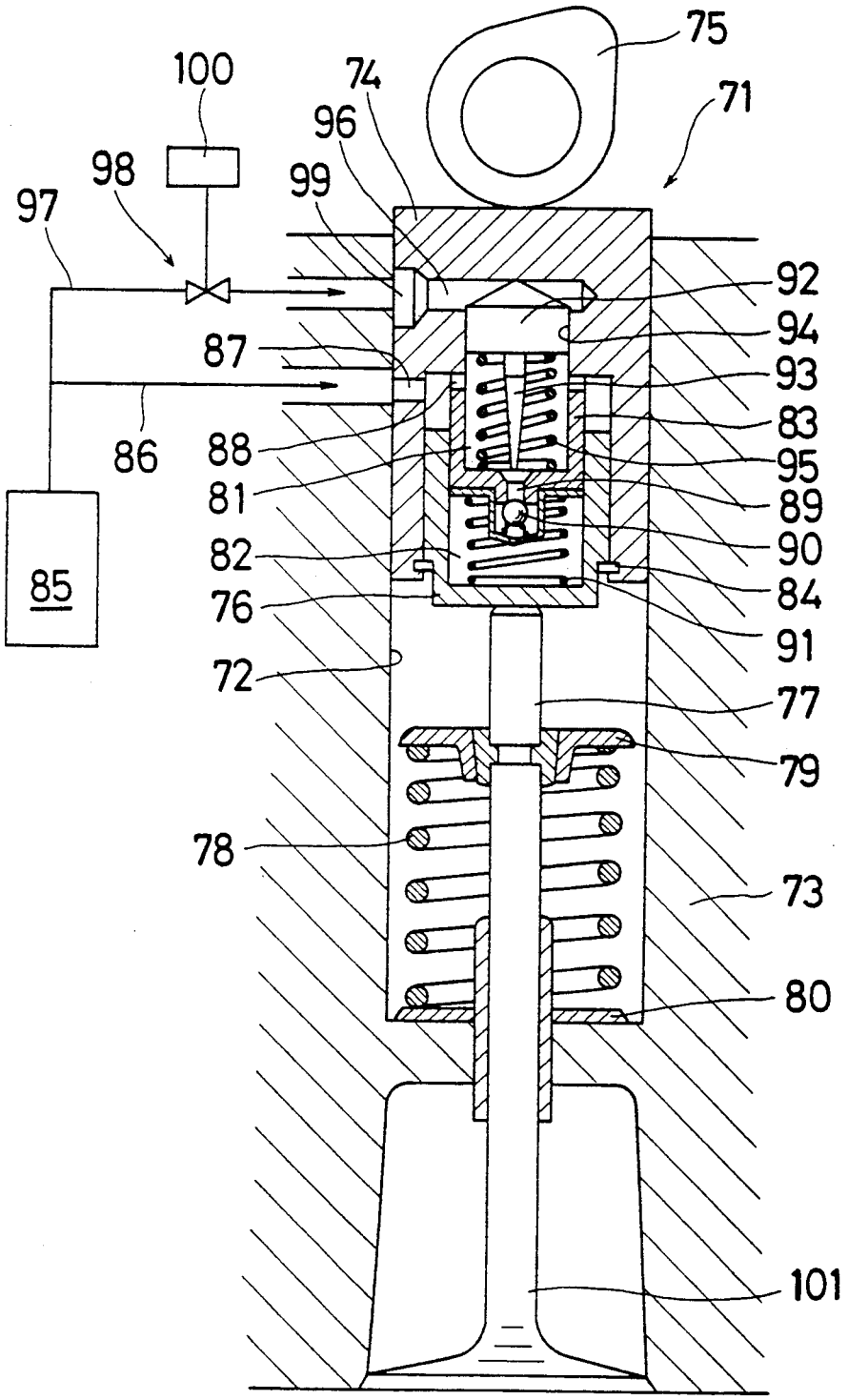
Fig. 2 (PRIOR ART)
FIG. 2 is an elevational view f a conventional hydraulic valve lifter having function to stop valve drive.

Referring to FIG. 1 wherein a hydraulic valve lifter 11 is located and slides in a cylinder 12 formed in an engine block 13. A lifter body 14 contacts with an outer surface of a cam 16 and a tappet 15 contacts with one end of a valve stem 17. The cam 16 drives the lifter body 14. A ring 18 prevents the tappet 15 from falling out from the lifter body 14. A valve spring 19 is interposed between a retainer 20 fixed to the valve stem 17 and a retainer 21 located on a bottom of the cylinder 12.

The lifter body 14 comprises a first, second and third body 22, 23 and 24. A first reservoir 25 is formed in the third body 245, and is in fluid communication with a hydraulic source 26. A room formed between the liter body 14 and the tappet 15 is divided to a second reservoir 27 and a first pressure room 28 via a plunger 29. The second reservoir 27 is in fluid communication with the first reservoir 25. The first pressure room 28 is in fluid communication with the second reservoir 27 via an orifice 30. The orifice 30 is opened and closed by a check valve 31. A spring 32 is interposed between the tappet 15 and the plunger 29 and urges the tappet 15 downwardly.

A second pressure room 33 is separated from a room 34 via a piston 35 having a rod 36, and is formed in first and second body 22, 23. A spring 37 urges the piston 35 upwardly. The second pressure room 33 is in fluid communication with the hydraulic source 26 via a valve 38 controlled by a controller 39 and a passage 40 formed in the first body 22. The room 34 is in fluid communication with an oil pan 41 via a passage 42 formed in the third body 24.

In the above mentioned hydraulic valve lifter 11, when the valve 31 is closed, a pressure in the second pressure room 33 is low. So the rod 36 parts from the check valve 31, and the first pressure room 28 has been kept in high pressure condition by supplied the hydraulic pressure from the hydraulic source 26. Thus, a rotating torque of the cam 16 is transmitted to a valve 43 via the lifer body 14, plunger 29, the first pressure room 28 having a rigidity by the hydraulic pressure therein and tappet 15.

In general, a gas mileage of an engine is better when the engine is driven in high load condition. So, in an engine having multi-cylinders, a working of some cylinders are stopped when the engine is driven in low load condition, so that the total load of the engine is high relatively. When the working of some cylinders are stopped, valves of the cylinders is stopped.

Namely, if a vertical motion of the valve 43 is not needed, the controller 39 controls the valve 38 in the opening condition. So, the second pressure room 33 becomes in high pressure condition, and the rod 36 presses the check valve 31 via the piston 35. Here, an oil in the room 34 flows out to the oil pan 41 via the passage 42, so that the piston does not receive any urging force upwardly except of the urging force of the spring 37. Thus, the first pressure room 28 is in fluid communication with the second reservoir 27 via the orifice 30, and an oil goes and returns between the first pressure room 28 and the second reservoir 27. So, the rigidity of the first pressure room 28 disappears. As a result the rotating torque of the cam 16 is into transmitted to the valve 43.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic valve lifter having function to stop valve drive comprising:

a cylinder;

a lifter body sliding in the cylinder;

a cam driving the lifter body;

a tappet sliding in the lifter body;

a valve driven by the tappet;

a plunger located between the lifter body and the tappet;

a reservoir formed in the lifter body and being in fluid communication with a hydraulic source always;

a first pressure room formed in the tappet and separated from the reservoir via the plunger;

a check valve controlling a communication between the reservoir and the first pressure room;

a piston sliding in the lifter body and having a rod driving the check valve;

a second pressure room located at one side of the piston and being in fluid communication with the hydraulic source via a control valve;

a room located at the other side of the piston; and a passage decreasing a pressure in the room.

2. A hydraulic valve liter having function to stop valve drive as set forth in claim 1 further comprising a controller for controlling the control valve in the opening condition when a vertical motion of the valve is not needed.

* * * * *